US009091478B2

(12) United States Patent
Judas et al.

(10) Patent No.: US 9,091,478 B2
(45) Date of Patent: Jul. 28, 2015

(54) METHOD AND APPARATUS FOR SEPARATING AIR BY CRYOGENIC DISTILLATION

(75) Inventors: Frederic Judas, Oberursel (DE); Herve Le Bihan, Sucy-en-Brie (FR); Patrick Le Bot, Vincennes (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 722 days.

(21) Appl. No.: 13/384,432

(22) PCT Filed: Jul. 16, 2010

(86) PCT No.: PCT/FR2010/051492

§ 371 (c)(1),
(2), (4) Date: Jan. 17, 2012

(87) PCT Pub. No.: WO2011/010049

PCT Pub. Date: Jan. 27, 2011

(65) Prior Publication Data

US 2012/0118006 A1 May 17, 2012

(30) Foreign Application Priority Data

Jul. 20, 2009 (FR) ..... 09 55007

(51) Int. Cl.
*F25J 3/00* (2006.01)
*F25J 3/04* (2006.01)

(52) U.S. Cl.
CPC ..... *F25J 3/04781* (2013.01); *F25J 3/0409* (2013.01); *F25J 3/04018* (2013.01); *F25J3/04024* (2013.01); *F25J 3/04054* (2013.01); *F25J 3/04175* (2013.01); *F25J 3/04296* (2013.01); *F25J 3/04393* (2013.01); *F25J 3/04412* (2013.01); *F25J 3/04448* (2013.01); *F25J 3/04454* (2013.01); *F25J 3/04775* (2013.01); *F25J 3/04824* (2013.01); *F25J 2230/08* (2013.01); *F25J 2230/30* (2013.01); *F25J 2230/40* (2013.01); *F25J 2240/04* (2013.01); *F25J 2240/10* (2013.01); *F25J 2240/42* (2013.01); *F25J 2245/40* (2013.01)

(58) Field of Classification Search
CPC . F25J 3/04024; F25J 3/04054; F25J 3/04381; F25J 3/04448; F25J 3/04812; F25J 3/042824; F25J 3/0483; F25J 3/04836; F25J 3/04842; F25J 3/0409; F25J 3/040296; F25J 2240/04; F25J 2210/06; F25J 2230/02; F25J 2230/04; F25J 2230/08; F25J 2230/20; F25J 2230/22; F25J 2230/24; F25J 2230/30; F25J 2280/02; F25J 2280/30; F25J 3/04012; F25J 3/04018; F25J 3/04048; F25J 3/04109; F25J 3/04781
USPC ..... 62/643, 644, 645, 646, 647, 654, 656
See application file for complete search history.

(56) References Cited

U.S. PATENT DOCUMENTS

| | | | | |
|---|---|---|---|---|
| 5,400,600 | A * | 3/1995 | Grenier | 62/646 |
| 5,881,570 | A * | 3/1999 | Drnevich et al. | 62/646 |
| 7,464,568 | B2 * | 12/2008 | Le Bot et al. | 62/646 |
| 2005/0126221 | A1 | 6/2005 | Ha et al. | |
| 2009/0007595 | A1 * | 1/2009 | Brugerolle et al. | 62/643 |

FOREIGN PATENT DOCUMENTS

| | | |
|---|---|---|
| DE | 102007014643 | 9/2007 |
| FR | 2895068 | 6/2007 |
| FR | 2913759 | 9/2008 |
| GB | 1500610 | 2/1978 |
| WO | 2004099690 | 11/2004 |
| WO | WO 2009021350 | 2/2009 |

OTHER PUBLICATIONS

PCT/FR2010/051492, International Search Report, Sep. 6, 2012.
PCT/FR2010/051492, Written Opinion of the International Searching Authority, Sep. 20, 2012.

* cited by examiner

*Primary Examiner* — Frantz Jules
*Assistant Examiner* — Keith Raymond
(74) *Attorney, Agent, or Firm* — Justin K. Murray

(57) ABSTRACT

The invention relates to equipment for separating air by cryogenic distillation, including: a double air separation column; an exchange line (91); a hot air supercharger (CI) and a cold air supercharger (C2); a first turbine (TI) and a second turbine (T2), each of which is coupled to one of the superchargers; means for bringing all the air to a high pressure that is greater than the mean pressure; means for purifying the air at said high pressure; means for dividing the purified air into two fractions and sending one fraction thereof to the hot air supercharger and one fraction to the cold air supercharger after cooling in the exchange line; means for feeding the second air fraction from the cold air supercharger back into the exchange line; means for sending at least one pressurized liquid from one of the columns into the exchange line; a valve (4, 5); means for sending the non-supercharged air, purified at a high pressure, to the exchange line, so as to be cooled therein, and then to the valve; and means for sending the air, expanded in the valve, to be distilled and/or to the atmosphere.

11 Claims, 1 Drawing Sheet

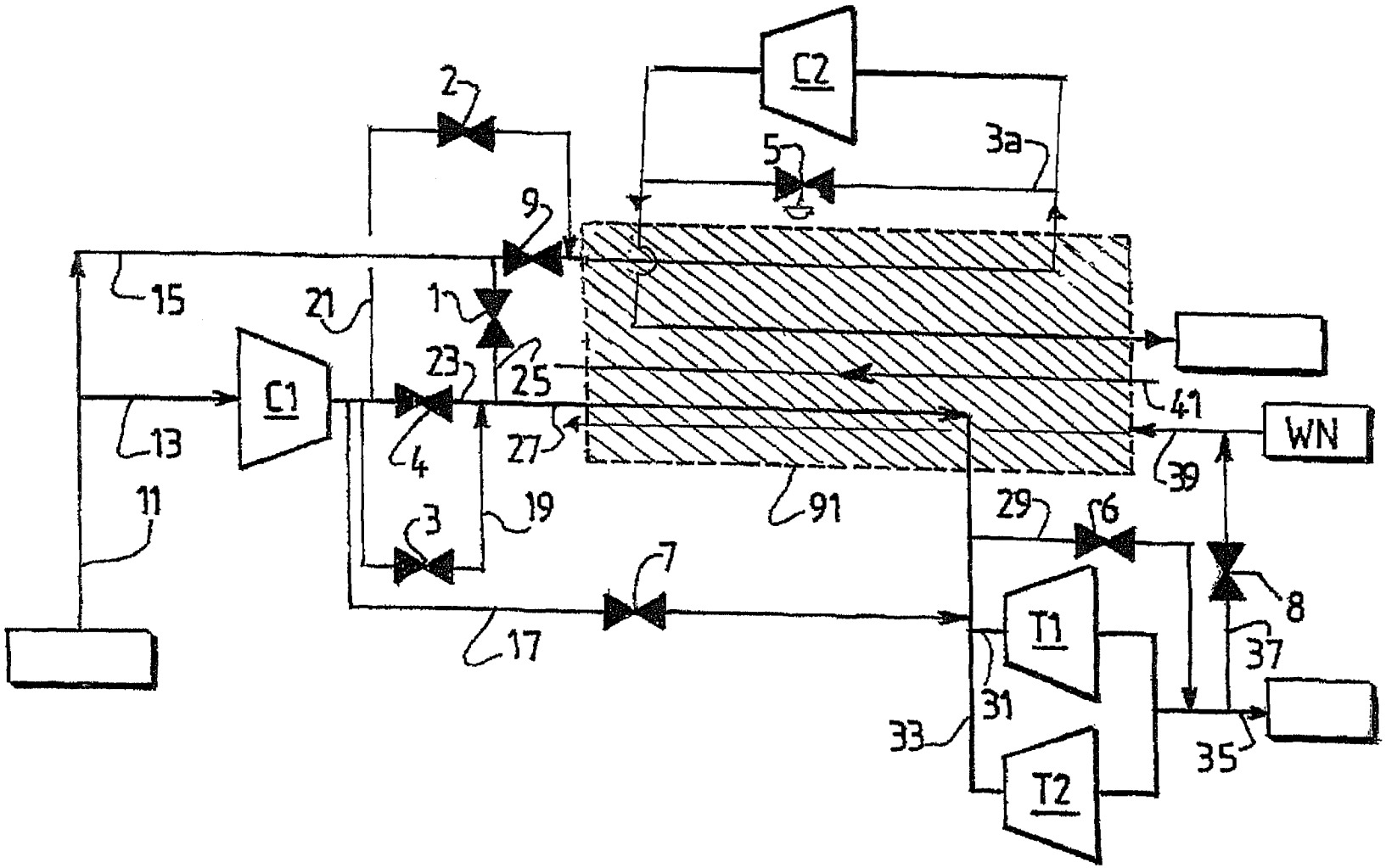
WN
C2
C1
T1
T2
1
2
3
4
5
6
7
8
9
11
13
15
17
19
21
23
25
27
29
31
33
35
37
39
41
91
3a

METHOD AND APPARATUS FOR SEPARATING AIR BY CRYOGENIC DISTILLATION

CROSS-REFERENCE TO RELATED APPLICATIONS

This application is a §371 of International PCT Application PCT/FR2010/051492, filed Jul. 16, 2010, which claims §119 (a) foreign priority to French Application 0955007, filed Jul. 20, 2009

BACKGROUND

Field of the Invention

The present invention relates to a method and to an apparatus for separating air by cryogenic distillation.

SUMMARY OF THE INVENTION

The invention applies in particular to methods for separating air that use a hot air booster, a cold air booster and two air turbines.

A cold air booster is a booster which is supplied with air at a lower temperature than the temperature at the hot end of the main exchange line of the apparatus, and is typically supplied with air at less than −20° C.

A method of this kind is illustrated in WO-A-2004099690.

In this method, which uses a conventional double column having a medium-pressure column and a low-pressure column which are connected thermally together, the purified air coming from the main compressor is divided into two portions. One portion is sent to a hot booster, cooled in the exchange line to an intermediate temperature, and then expanded in two Claude turbines connected in parallel. One portion of the air coming from the hot booster may possibly be liquefied in the exchange line instead of being sent to the turbines.

The rest of the air coming from the main compressor is cooled in the exchange line without being boosted upstream of the latter and is boosted in a cold booster at an intermediate temperature of the exchange line, returned into the exchange line at an intermediate temperature of the exchange line, liquefied and sent to at least one column of the double column.

At least one waste gas is heated up in the exchange line, in which a pressurized liquid coming from the double column, in particular oxygen, is also vaporized.

The optimal configuration in this case is to supply the cold booster at a pressure close to the outlet pressure of the main compressor. The rest of the air (about 70% of the flow) supplies the Claude turbines after passing through the hot booster. If the cold booster fails, the outlet pressure of the main compressor is highly insufficient for vaporizing oxygen.

The present invention aims to find a solution to this problem.

According to one subject of the invention, there is provided a method for separating air by cryogenic distillation in an installation comprising a double or triple air-separation column, of which the column operating at the highest pressure operates at what is called a medium pressure, and an exchange line where all the air intended for the distillation unit is cooled, in which method, in normal operation:

a) all the air is brought to a high pressure at least 5 bar higher than the medium pressure and is purified at this high pressure, b) the purified air is divided into two fractions, c) a first fraction at the high pressure is sent to a hot booster, and the first boosted fraction is cooled in the exchange line to an intermediate temperature, d) the first cooled fraction is divided into two portions, and each portion is expanded in a respective turbine, e) the intake pressure of the first and second turbines is, or the pressures of the two turbines are, higher or at least 5 bar higher than the medium pressure, f) the delivery pressure of at least one of the two turbines is approximately equal to the medium pressure, g) at least one portion of the air expanded in at least one of the turbines is sent to the medium-pressure column of the double or triple column, h) a second fraction of the air purified at the high pressure is cooled in a first series of passages in the exchange line and then boosted at an intake temperature equal to an intermediate temperature in the exchange line in a cold booster mechanically connected to the second turbine, the hot booster being mechanically connected to the first turbine, i) the cold booster delivers the second fraction of air at a temperature higher than the intake temperature, and the second fraction of air boosted in this way is reintroduced into a second series of passages in the exchange line, possibly at an intermediate point of the latter, in which at least one portion of the second fraction is condensed or undergoes pseudo-condensation, j) at least one pressurized liquid coming from one of the columns of the double or triple column is vaporized or undergoes pseudo-vaporization in the exchange line at a vaporization temperature, and said method is characterized in that if the cold booster is not operating, a first portion of the air purified at the high pressure is sent to the hot booster, is liquefied and is sent to at least one column of the double or triple column and/or air coming from the hot booster and/or which has bypassed the hot booster is cooled in the exchange line and is expanded in the turbine coupled to the hot booster before being sent at least in part to the column operating at the medium pressure.

According to further optional features:

if the cold booster is not operating, a second portion of the purified air is cooled at the high pressure to an intermediate temperature of the exchange line, is expanded in a valve and then sent into the atmosphere without having been boosted by the hot booster, preferably after being heated up in the exchange line;

if, and possibly only if, the cold booster is not operating, one portion or the portion of the air boosted in the hot booster is cooled in the first series of passages in the exchange line, exits the exchange line without passing through the cold booster and returns into the exchange line in the second series of passages, the air then being sent to the system of columns once it has passed through these two series of passages;

if, possibly only if, the cold booster is not operating, air coming from the hot booster is cooled in the exchange line and is expanded in the turbine coupled to the hot booster before being sent at least in part to the column operating at the medium pressure;

if, possibly only if, the cold booster is not operating, air that has bypassed the hot booster is cooled in the exchange line and is expanded in the turbine coupled to the hot booster before being sent at least in part to the column operating at the medium pressure;

if the hot booster is not operating, preferably only if the hot booster is not operating, the third portion of the purified air is sent at the high pressure to the turbine coupled to the cold booster without having been boosted in the cold booster.

According to another subject of the invention, there is provided an installation for separating air by cryogenic distillation, comprising:

a) a double or triple air-separation column, of which the column operating at the highest pressure operates at what is called a medium pressure, b) an exchange line, c) a hot booster and a cold booster, d) a first turbine and a second turbine, each of which is coupled to one of the boosters, e) means for bringing all the air to a high pressure higher than the medium pressure and means for purifying it at this high pressure, f) means for dividing the purified air into two fractions and for sending a first fraction thereof to the hot booster and a second fraction to the cold booster after it has been cooled in a first series of passages in the exchange line, g) means for reintroducing the second fraction of air coming from the cold booster into a second series of passages in the exchange line in order to be cooled therein, h) means for sending at least one pressurized liquid coming from one of the columns into the exchange line, i) means for sending cooled air coming from the hot booster through the exchange line to the first and second turbines, j) a valve, means for sending non-boosted air purified at the high pressure to the exchange line in order to be cooled therein and then to the valve, and means for sending the air expanded in the valve to the distillation unit and/or into the atmosphere, and/or k) means for connecting the delivery side of the hot booster to the first series of passages in the exchange line.

Optionally, the installation may comprise:

means for short-circuiting the cold booster, these means being connected to the exchange line and to the delivery side of the cold booster, such that the air passes from the first series of passages to the second series of passages without passing through the cold booster;

means for short-circuiting the first and second turbines, these means being connected to the delivery side of the hot booster and to the cold end of the exchange line and/or to the system of columns;

the means for short-circuiting the first and second turbines are connected to the inlet of the cold booster;

a valve, means for sending non-boosted air purified at the high pressure to the exchange line in order to be cooled therein and then to the valve, and means for sending the air expanded in the valve to the distillation unit and/or into the atmosphere;

the valve is connected to the inlet and to the delivery side of at least one of the turbines;

means for connecting the delivery side of the hot booster to the first series of passages in the exchange line;

means for preventing the air from reaching the inlet of one of the turbines;

a valve connecting the first series of passages to the second series of passages.

According to one subject of the invention, there is provided a method for separating air by cryogenic distillation in an installation comprising a double or triple air-separation column, of which the column operating at the highest pressure operates at what is called a medium pressure, and an exchange line where all the air intended for the distillation unit is cooled, in which method, in normal operation:

a) all the air is brought to a high pressure at least 5 bar higher than the medium pressure and is purified at this high pressure, b) the purified air is divided into two fractions, c) a first fraction at the high pressure is sent to a hot booster, and the first boosted fraction is cooled in the exchange line to an intermediate temperature, d) the first cooled fraction is divided into two portions, and each portion is expanded in a turbine, e) the intake pressure of the first and second turbines is (the pressures of the two turbines are) at least 5 bar higher than the medium pressure, f) the delivery pressure of at least one of the two turbines is approximately equal to the medium pressure, g) at least one portion of the air expanded in at least one of the turbines is sent to the medium-pressure column of the double or triple column, h) a second fraction of the air purified at the high pressure is cooled in a first series of passages in the exchange line and then boosted at an intake temperature equal to an intermediate temperature in the exchange line in a cold booster mechanically connected to the second turbine, the hot booster being mechanically connected to the first turbine, i) the cold booster delivers the second fraction of air at a temperature higher than the intake temperature, and the second fraction of air boosted in this way is reintroduced into a second series of passages in the exchange line, possibly at an intermediate point of the latter, in which at least one portion of the second fraction undergoes (pseudo-)condensation, j) at least one pressurized liquid coming from one of the columns of the double or triple column undergoes (pseudo-)vaporization in the exchange line at a vaporization temperature, and said method is characterized in that if one of the boosters is not operating, a first portion of the air purified at the high pressure is sent to the booster that is still operating, a second portion of the purified air is cooled at the high pressure to an intermediate temperature of the exchange line, is expanded and then sent into the atmosphere without having been boosted by the booster that is still operating, preferably after being heated in the exchange line, and a third portion of the purified air is cooled at the high pressure to an intermediate temperature of the exchange line, is expanded in the turbine coupled to the booster that is still operating and then sent at least in part to the column operating at the medium pressure without having been boosted by the booster that is still operating.

Optionally:

the second portion of the purified air is sent into the atmosphere only when one of the boosters is not operating;

if, possibly only if, the cold booster is not operating, one portion of the air boosted in the hot booster is cooled in the exchange line, is liquefied and is sent to at least one column of the double or triple column;

if, possibly only if, the cold booster is not operating, the portion of the air boosted in the hot booster is cooled in the first series of passages in the exchange line, exits the exchange line without passing through the cold booster and returns into the exchange line in the second series of passages, the air then being sent to the system of columns once it has passed through these two series of passages;

if, possibly only if, the cold booster is not operating, air coming from the hot booster and/or which has bypassed the hot booster is cooled in the exchange line and is expanded in the turbine coupled to the hot booster before being sent at least in part to the column operating at the medium pressure;

if the hot booster is not operating, preferably only if the hot booster is not operating, the third portion of the purified air is sent at the high pressure to the turbine coupled to the cold booster without having been boosted in the cold booster.

According to another subject of the invention, there is provided an installation for separating air by cryogenic distillation, comprising:

a) a double or triple air-separation column, of which the column operating at the highest pressure operates at what is called a medium pressure, b) an exchange line, c) a hot booster and a cold booster, d) a first turbine and a second turbine, each of which is coupled to one of the boosters, e) means for bringing all the air to a high pressure higher than the medium pressure and means for purifying it at this high pressure, f) means for dividing the purified air into two fractions and for sending one fraction thereof to the hot booster and one fraction to the cold booster after it has been cooled in the exchange line, g) means for reintroducing the second fraction of air coming from the cold booster into the exchange line, h) means for sending at least one pressurized liquid coming from one of the columns into the exchange line, and i) a valve, means for sending non-boosted air purified at the high pressure to the exchange line in order to be cooled therein and then to the valve, and means for sending the air expanded in the valve to the distillation unit and/or into the atmosphere.

Optionally:

the installation comprises means for bypassing the cold booster, these means being connected to the exchange line, preferably only to the exchange line;

the installation comprises means for bypassing the first and second turbines, these means being connected to the hot booster and to the cold end of the exchange line and/or to the system of columns;

the means for bypassing the first and second turbines are connected to the cold booster.

In normal operation:

the intake and delivery conditions of the two turbines are close or identical in terms of pressure and temperature;

the air sent to the turbines is at the outlet pressure of the hot booster;

at least one portion of the air boosted in the hot booster is sent to the turbines;

optionally, one portion of the air coming from the hot booster is cooled against at least one liquid which is vaporized in the exchange line, said portion of the air is expanded, liquefied and sent to a column of the double or triple column;

at least one end product in liquid form is produced;

all the gaseous air intended for the columns of the double or triple column comes from the air expansion turbines.

BRIEF DESCRIPTION OF THE FIGURES

FIG. 1 shows part of the apparatus for separating air.

The invention will be described in more detail with reference to the FIGURE, which shows a part of the apparatus for separating air according to the invention.

DETAILED DESCRIPTION OF THE INVENTION

In this method using a double column (not illustrated), in normal operation, the air 11 coming from the main compressor (not illustrated) and from a purification unit (not illustrated) is divided into only two portions. One portion 13 is sent to a hot booster C1, cooled to an intermediate temperature in the exchange line 91 and then sent through the open valve 4 and the ducts 23, 27 in order to be expanded in the two turbines T1, T2 connected in parallel by the ducts 31, 35. The expanded air 35 coming from the turbines T1, T2 is sent to the medium-pressure column of the double column.

One portion of the air coming from the hot booster C1 may optionally be liquefied in the exchange line instead of being sent to the turbines.

The rest 15 of the air coming from the main compressor is cooled in a first series of passages of the exchange line 91 by passing through the open valve 9 and is boosted in a cold booster C2 at an intermediate temperature of the exchange line, returned into the exchange line at an intermediate temperature thereof in a second series of passages, liquefied and sent to at least one column of the double column, for example the medium-pressure column. Even though the FIGURE only illustrates a single passage, it will be understood that there will be a plurality of parallel passages to allow the transport of the flow.

At least one waste gas WN arrives from the low-pressure column through the duct 39 and is heated up in the exchange line where a pressurized liquid 41 coming from the double column, in particular pressurized oxygen, is also vaporized.

In this case of normal operation, the valves 1, 2, 5 and 6 are closed such that the ducts 21, 25, 29, 39 do not receive any air.

The ducts 19 and 17 do not have to be present and the operation thereof will not be described. It is assumed that the valves 3 and 7 are closed for the explanation of the method according to the invention.

If the cold booster C2 is not operating, the air 11 coming from the main compressor (not illustrated) is divided into two portions. One portion 13 is sent to the hot booster C1. Since the valves 1, 2 and 4 are open and valve 9 is closed, the air boosted in the hot booster C1 is sent in part to the duct 21 and in part to the duct 23, 27. The air passing through the duct 23, 27 and the valve 4 is cooled to an intermediate temperature in the exchange line 91 in order to be expanded in a single Claude turbine T1. The turbine T2 is not operating because it is usually coupled to the cold booster C2. The expanded air 35 is sent to the medium-pressure column of the double column.

The air sent through the duct 21 and the valve 2 is cooled to an intermediate temperature of the exchange line 91 in the latter in the passages where the air intended for the cold booster C2 is normally cooled. The air is sent to the valve 5 through the duct 39 at an intermediate temperature of the exchange line through the passages through which the air coming from the cold booster C2 normally flows. The air coming from the valve 5 is liquefied before being sent to at least one column of the double column.

One portion of the air coming from the duct 27 may optionally likewise be liquefied in the exchange line instead of being sent to the turbines.

The rest 15 of the air coming from the main compressor is sent through the valve 1 and the ducts 25, 27 to cool with the air coming from the valve 4 to an intermediate temperature in the exchange line 91.

One portion of the air coming from the duct 25 is expanded in the remaining turbine T1 and the rest is expanded in a valve 6 which bypasses the turbine T1 and mixes with the waste gas WN in order to be heated up in the exchange line.

At least one waste gas WN arrives through the duct 39 and is heated up in the exchange line where a pressurized liquid 41 coming from the double column, in particular oxygen, is also vaporized.

If the hot booster fails, the valves 2 and 4 are closed, the valves 1, 6 and 9 are open and all of the air 11 coming from the main compressor (not illustrated) is sent through the duct 15 and divided into two portions. One portion passes through the valve 1 and the duct 23, 27 in order to be sent to the exchange line 91 to an intermediate temperature in order to be expanded in part in a single turbine T2. The turbine T1 is not operating because it is usually coupled to the hot booster C1. The rest of the air at intermediate temperature is expanded in the valve 6 and mixed with the residual gas 39 in order to be heated up in the exchange line.

The air sent through the valve 9 is cooled in the exchange line 91 and is boosted in the cold booster C2, returned to the exchange line 91 and liquefied.

One portion of the air coming from the duct 25 may optionally likewise be liquefied in the exchange line instead of being sent to the turbine T2.

At least one waste gas WN arrives through the duct 39 and is heated up in the exchange line where a pressurized liquid 41 coming from the double column, in particular oxygen, is also vaporized.

If the hot booster fails, the valves 2 and 4 are closed such that the ducts 13, 21, 31, 39 do not receive any air.

It is possible to provide only means that operate when the hot booster has failed or only means that operate when the cold booster has failed.

For a further understanding of the nature and objects for the present invention, reference should be made to the detailed description, taken in conjunction with the accompanying drawing, in which like elements are given the same or analogous reference numbers and wherein:

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for separating air by cryogenic distillation in an installation comprising a double or triple air-separation column, of which the column operating at the highest pressure operates at a medium pressure, and an exchange line where all the air intended for the distillation unit is cooled, the method comprising the steps of:

a) pressurizing all the air to a high pressure at least 5 bar higher than the medium pressure and purifying the air at this high pressure to produce purified air;

b) dividing the purified air into more than one fraction;

c) sending a first fraction of the purified air at the high pressure to a hot booster, and then cooling in the exchange line to a first intermediate temperature; to form a first cooled fraction, d) dividing the first cooled fraction into a first portion and a second portion, and then expanding the first portion in a first turbine and expanding the second portion in a second turbine, to form a first expanded air stream and a second expanded air stream, respectively, wherein the first expanded air stream and the second expanded air stream are at a pressure that is approximately equal to the medium pressure;

e) sending at least one of the first expanded air stream and the second expanded air stream to the column of the double or triple column operating at the medium pressure;

f) cooling a second fraction of the purified air at the high pressure in a first series of passages in the exchange line to a second intermediate temperature and then boosting in a cold booster to produce a boosted second fraction, wherein the cold booster is mechanically connected to the second turbine and the hot booster is mechanically connected to the first turbine, wherein the boosted second fraction is at a temperature higher than the second intermediate temperature;

g) reintroducing the boosted second fraction into a second series of passages in the exchange line, in which at least one portion of the boosted second fraction is condensed or undergoes pseudo-condensation; and h) vaporizing or pseudo-vaporizing at least one pressurized liquid coming from one of the columns of the double or triple column in the exchange line at a vaporization temperature, and i) wherein if the cold booster is not operating, air coming from the hot booster and the second fraction of the air purified at the high pressure, which has bypassed the hot booster, are both cooled in the exchange line to form the first cooled fraction, wherein the first cooled fraction is expanded in the first turbine coupled to the hot booster before being sent at least in part to the column operating at the medium pressure.

2. The method of claim 1, in which if the cold booster is not operating, a second portion of the purified air is cooled at the high pressure to a third intermediate temperature of the exchange line, is expanded in a valve and then sent into the atmosphere without having been boosted by the hot booster.

3. The method of claim 1, in which if the cold booster is not operating, one portion or the portion of the air boosted in the hot booster is cooled in the first series of passages in the exchange line, exits the exchange line without passing through the cold booster and returns into the exchange line in the second series of passages, the air then being sent to the system of columns once the air has passed through these two series of passages.

4. The method of claim 1, in which if the cold booster is not operating, air coming from the hot booster is cooled in the exchange line and is expanded in the turbine coupled to the hot booster before being sent at least in part to the column operating at the medium pressure.

5. The method of claim 1, in which if the cold booster is not operating, air that has bypassed the hot booster is cooled in the exchange line and is expanded in the turbine coupled to the hot booster before being sent at least in part to the column operating at the medium pressure.

6. The method of claim 1, in which if the hot booster is not operating a portion of the second fraction of the purified air is sent at the high pressure to the second turbine, which is coupled to the cold booster without having been boosted in the cold booster.

7. The method of claim 1, further comprising the step of determining if the cold booster is in operation and performing step i) if and only if it is determined that the cold booster is not in operation.

8. The method of claim 1, wherein if the cold booster is not operating, no air flows through the second turbine.

9. The method of claim 1, wherein if the cold booster is not operating, dividing the first cooled fraction into the first portion and the second portion, expanding the first portion in the first turbine and expanding the second portion in an expansion valve, such that no air flows through the second turbine.

10. A method for separating air by cryogenic distillation in an installation comprising a double or triple air-separation column, of which the column operating at the highest pressure operates at a medium pressure, and an exchange line, the method comprising a first mode of operation and a second mode of operation, wherein all modes of operation comprise the steps of:

a. pressurizing all the air to a high pressure at least 5 bar higher than the medium pressure and purifying the air at this high pressure to produce purified air;

b. dividing the purified air into more than one fraction;

c. sending a first fraction of the purified air at the high pressure to a hot booster, and then cooling the first fraction of the purified air in the exchange line to a first intermediate temperature to form a first cooled fraction;

d. dividing the first cooled fraction into a first portion and a second portion, and then expanding the first portion in a first turbine and the second portion in a second turbine to form a first expanded air stream and a second expanded air stream, respectively, Wherein the first expanded air stream and the second expanded air stream are at a pressure that is approximately equal to the medium pressure;

e. sending at least one of the first expanded air stream and the second expanded air stream to the column of the double or triple column operating at the medium pressure; and f. vaporizing or pseudo-vaporizing at least one pressurized liquid coming from one of the columns of the double or triple column in the exchange line at a vaporization temperature wherein the first mode of operation further comprises the steps of:

g. cooling a second fraction of the purified air at the high pressure in a first series of passages in the exchange line to a second intermediate temperature and then boosting in a cold booster to produce a boosted second fraction, wherein the cold booster is mechanically connected to the second turbine and the hot booster is mechanically connected to the first turbine, wherein the boosted second fraction is at a temperature higher than the second intermediate temperature;

h, reintroducing the boosted second fraction into a second series of passages in the exchange line, in which at least one portion of the boosted second fraction is condensed or undergoes pseudo-condensation;

i. determining whether the cold booster is in operation; and j. switching to the second mode of operation if the cold booster is not in operation, wherein the second mode of operation further comprises the steps of:

k. sending a slip stream of the first fraction of the purified air following the hot booster and before cooling in the exchange line to the first series of passages in the exchange line and cooling to the second intermediate temperature, then flowing through a bypass valve to produce a cooled slip stream;

l. reintroducing the cooled slip stream into the second series of passages in the exchange line to be liquefied before being sent to the air-separation column;

m. sending the second fraction of the purified air at the high pressure through a bypass valve to mix with the first fraction of the purified air prior to being cooled in the exchange line to form the first cooled fraction; and n. diverting the second portion of the first cooled fraction away from the second turbine and to an expansion valve to form the second expanded air stream.

11. The method of claim 10, wherein the second mode of operation further comprises the step of combining at least a portion of the second expanded air stream with a waste gas from the air-separation column before being heated up in the exchange line.

* * * * *